US010525705B2

(12) United States Patent
Wang et al.

(10) Patent No.: US 10,525,705 B2
(45) Date of Patent: Jan. 7, 2020

(54) INKJET PRINTER WITH UNIVERSAL PRINT HEAD AND PRINT FRAME FOR BOTH HORIZONTAL AND VERTICAL PRINTING ON NON-FLAT SURFACES

(71) Applicant: KYOCERA Document Solutions Inc., Osaka (JP)

(72) Inventors: Hui Wang, Temple City, CA (US); Tomohiro Kuwahara, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/005,515

(22) Filed: Jun. 11, 2018

(65) Prior Publication Data

US 2019/0375208 A1 Dec. 12, 2019

(51) Int. Cl.

| | |
|---|---|
| ***B41J 2/085*** | (2006.01) |
| ***B41J 2/045*** | (2006.01) |
| *B41J 25/308* | (2006.01) |
| *B41J 2/185* | (2006.01) |

(52) U.S. Cl.

CPC ..... *B41J 2/04573* (2013.01); *B41J 2/04556* (2013.01); *B41J 2/04586* (2013.01); *B41J 2/085* (2013.01); *B41J 2/185* (2013.01); *B41J 25/3086* (2013.01)

(58) Field of Classification Search

CPC .... B41J 2/04573; B41J 2/085; B41J 2/04556; B41J 2/04586; B41J 2/185; B41J 25/3086

See application file for complete search history.

(56) References Cited

U.S. PATENT DOCUMENTS

| | | | | |
|---|---|---|---|---|
| 6,832,684 | B2 * | 12/2004 | Patton | B41J 11/008 33/18.1 |
| 6,832,864 | B2 * | 12/2004 | Patton | B41J 11/008 33/18.1 |
| 2008/0074477 | A1 * | 3/2008 | Schmitt | B41J 2/095 347/76 |
| 2010/0007689 | A1 * | 1/2010 | Hagiwara | B41J 19/207 347/19 |

* cited by examiner

*Primary Examiner* — Yaovi M Ameh
(74) *Attorney, Agent, or Firm* — Rowan TELS LLC

(57) ABSTRACT

A print head for an inkjet printer includes a nozzle, a first electrode positioned to receive an ink droplet from the nozzle, a second electrode positioned to receive the ink droplet from the first electrode, and a controller configured to operate the first electrode to ionize the ink droplet and set a flight speed of the ink droplet. The controller is further configured to selectively activate the second electrode to deflect the ink droplet in response to the print head changing from a horizontal printing orientation to a vertical printing orientation.

17 Claims, 9 Drawing Sheets

INKJET PRINTER WITH UNIVERSAL PRINT HEAD AND PRINT FRAME FOR BOTH HORIZONTAL AND VERTICAL PRINTING ON NON-FLAT SURFACES

BACKGROUND

Modern inkjet printers can print directly on uneven surfaces such as wood, metal, plastic and tile. However, most are not designed to also print on vertical surfaces such as walls, dividers, windows, and doors.

Traditional inkjet printers are primarily designed to print on flat surfaces such as paper and fabric. The limitations of conventional inkjet printers have limited their market for vertical surface printing. Because many inkjet printers use liquid inks, it is difficult to apply the ink on vertical surfaces due to distortions caused by gravity and limited print head configurability.

Recent inkjet printing technologies such as ultraviolet printing make it possible to directly print on rigid surfaces. The application of ultraviolet light can cure the ink quickly and firmly on the surface of these materials. However there is still a dearth of inkjet printers that can flexibly print on both horizontal and vertical surfaces that are uneven.

BRIEF DESCRIPTION OF THE SEVERAL VIEWS OF THE DRAWINGS

To easily identify the discussion of any particular element or act, the most significant digit or digits in a reference number refer to the figure number in which that element is first introduced.

DETAILED DESCRIPTION

Disclosed herein is a print frame and print head for a universal inkjet printer, which is readily adaptable between horizontal or vertical printing. The universal inkjet printer has a rotatable print frame for the print head. The print head includes a distance sensor that detects nozzle displacement from an irregular print surface at runtime and adjusts the nozzle displacement such that the ink droplet ejected from the nozzle hits the correct location on the print surface.

Figure 1:
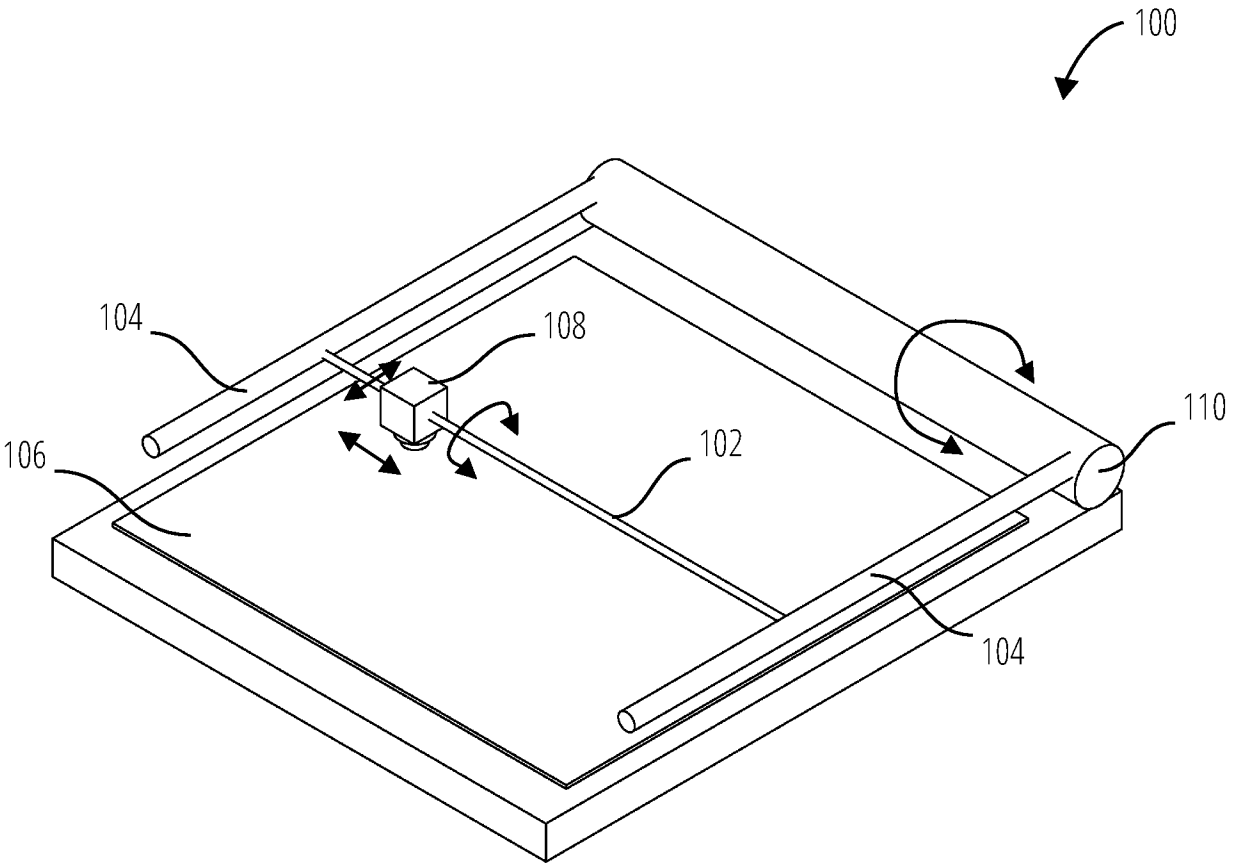
FIG. 1 illustrates a horizontal printing configuration 100 for an inkjet printer in accordance with one embodiment.
Figure 2:
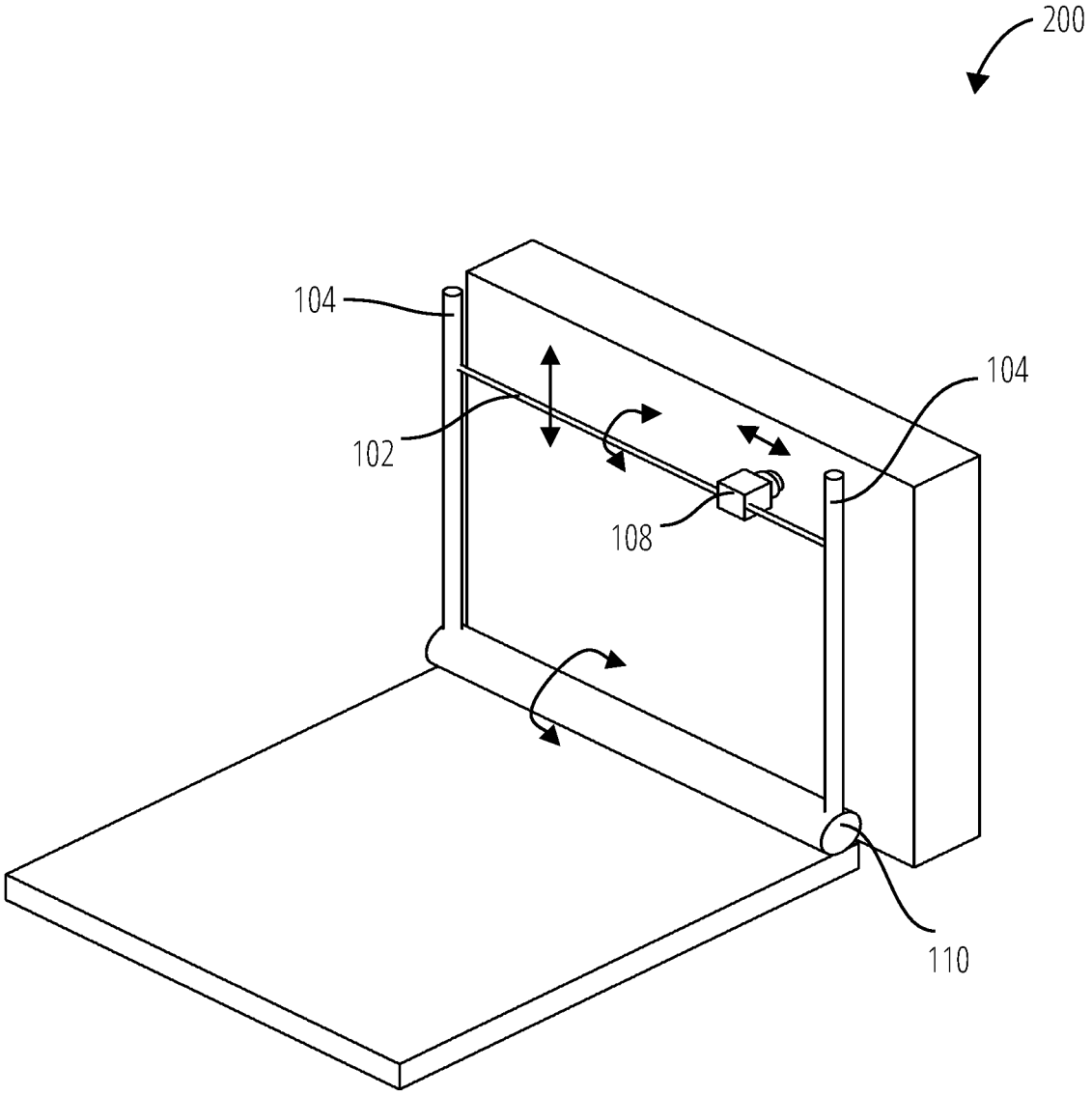
FIG. 2 illustrates a vertical printing configuration 200 in accordance with one embodiment.

Referring to FIG. 1, a horizontal printing configuration 100 of an inkjet printer embodiment comprises a transverse rail 102, side rails 104, a horizontal print surface 106, a print head 108, and a swivel 110. FIG. 2 illustrates the same components in a vertical printing configuration 200.

An inkjet printer may thus include a swivel 110, one or more side rails 104 mounted to the swivel 110, and a transverse rail 102 mounted to slide along a length of the side rails 104. A print head 108 is mounted to slide along a length of the transverse rail, and to rotate around the transverse rail 102. Further details of one embodiment of the print head 108 are illustrated in FIG. 3.

Figure 3:
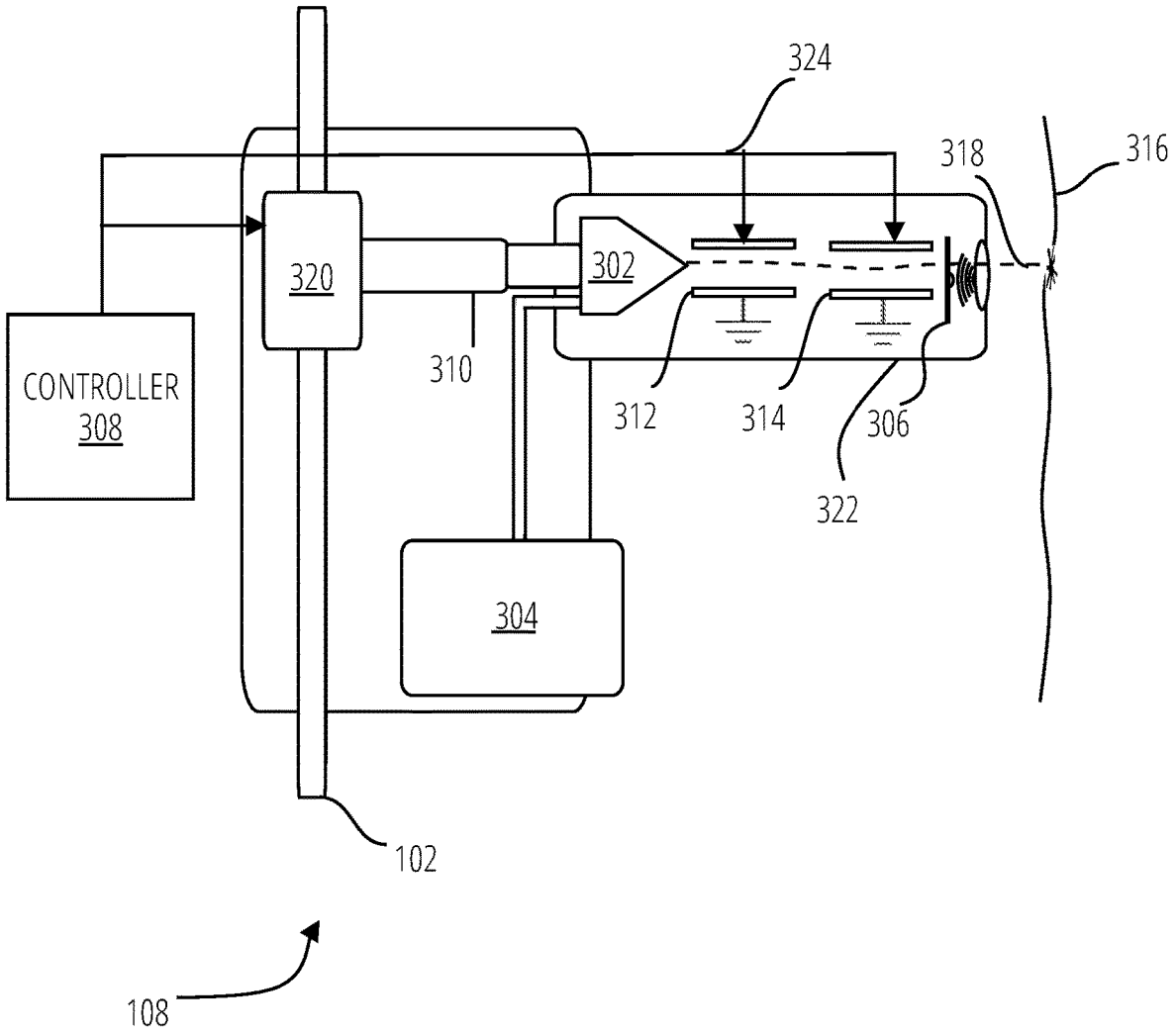
FIG. 3 illustrates a print head 108 in accordance with one embodiment.

Referring to FIG. 3, in one embodiment the print head 108 comprises a nozzle 302 coupled to an ink tank 304, and a linear actuator 310 that extends and retracts a print head face 322 based on signals from a controller 308 as influenced by readings from a distance sensor 306. A coupling 320 enables both rotational and translational motion of the print head 108 around and along the transverse rail 102, as determined by the controller 308.

Ink ejected from the nozzle 302 passes through a first electrode 312 and a second electrode 314, following an ink droplet path 318 before impacting an irregular vertical print surface 316. The controller 308 further influences the first electrode 312 and the second electrode 314 to precisely control the ink droplet path 318, as further described in conjunction with FIG. 5.

The controller 308 is configured with logic to operate the first electrode 312 to both ionize the ink droplet and set a flight speed of the ink droplet, and to selectively activate the second electrode 314 to deflect the ink droplet in response to the print head 108 changing from a horizontal printing configuration 100 ('horizontal orientation') to a vertical printing configuration 200 ('vertical orientation').

The controller 308 is further configured with logic to operate the second electrode 314 to fine-tune the flight speed of the ink droplet received from the first electrode 312 utilizing electrode control paths 324, in response to distance signals from the distance sensor 306.

The distance sensor 306 outputs a signal representing a measure of a distance between the print head 108 (and more particularly, the nozzle 302) and a print surface, for example a regular or irregular horizontal print surface 106 or a regular or irregular vertical print surface 316.

The controller 308 may operate the linear actuator 310 to set an initial nozzle displacement from the print surface based on the distance, and may dynamically alter the nozzle displacement from the print surface during printing, based on the distance. The linear actuator 310 may for example be a telescoping push/pull actuator. The linear actuator 310 is used to follow (maintain the print head at an approximately constant distance) as printing progresses along gross contours of a curved or otherwise irregular surface.

A coupling 320 provides both rotational and translational positioning of the print head 108 on a transverse rail 102. The first electrode 312 may set a flight speed of the ink droplet (e.g., using electrical charge gradients or by other means known in the art), and the second electrode 314 may in some cases fine tune the ink droplet speed based on fine irregularities in the print surface. Fine irregularities are those having a high slope derivative relative to the gross contour of the surface.

Figure 4:
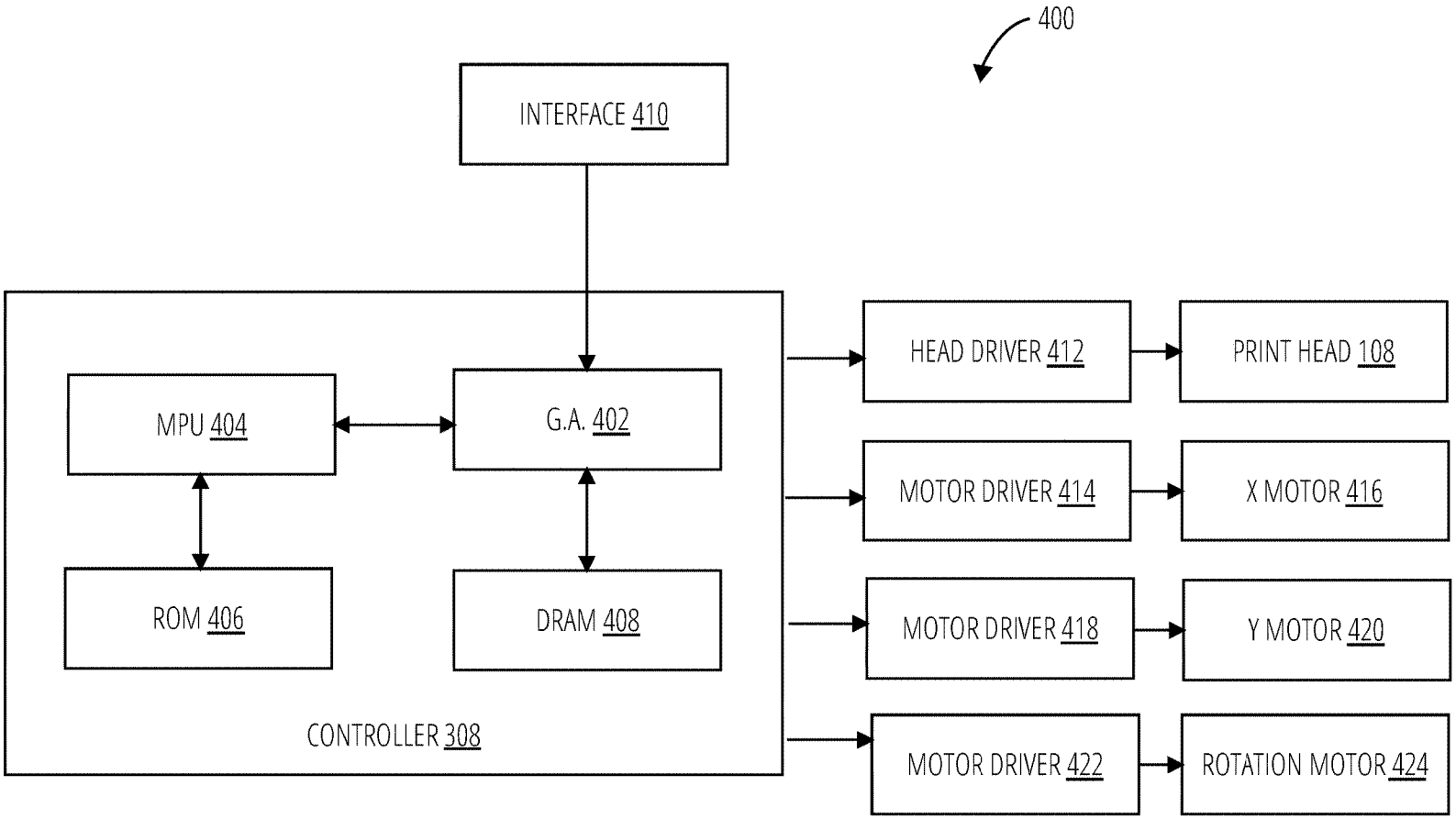
FIG. 4 illustrates an inkjet printer control system 400 in accordance with one embodiment.

Referring to FIG. 4, an inkjet printer control system 400 in one embodiment comprises a controller 308, a gate array 402, a multi-processing unit (MPU 404), a read-only memory (ROM 406), and a dynamic random access memory (DRAM 408). The controller 308 may comprise other components well known in the art, such as busses, memory controllers, clocks, capacitors, etc. The controller 308 receives printing commands from the interface 410 (e.g., a network or cable to a computer system) and controls a print head driver 412 which in turn drives a print head 108. The controller 308 further controls an X motor driver 414 that drives an X motor 416, a Y motor driver 418 that drives a Y motor 420, and a rotation motor driver 422 that drives a rotation motor 424. The motors provide X-Y translation and rotation of the print head 108 as described in conjunction with FIG. 1 and FIG. 2.

Upon receiving print commands from the interface 410, the gate array 402 (which may be any type of programmable device known in the art) and the MPU 404 interact to translate the print commands into control functions to the various drivers. The ROM 406 and DRAM 408 comprise logic to carry out this translation, in manners known in the art. In accordance with the print commands, the motor drivers operate the motors to position the print head 108 and to drive the linear actuator 310 and electrodes as described herein.

Figure 5:
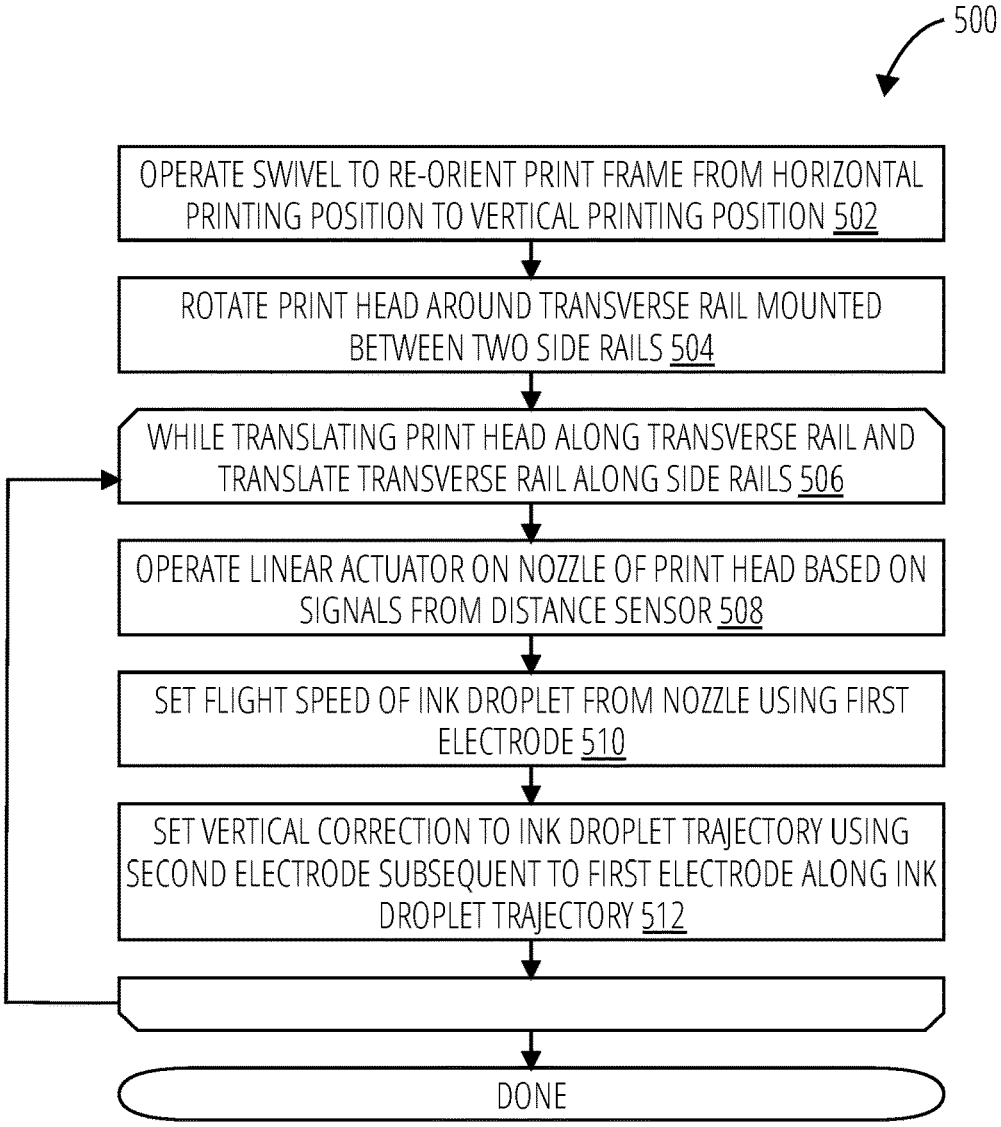
FIG. 5 illustrates a printing process 500 in accordance with one embodiment.

Referring to FIG. 5, a method of operating an inkjet printer involves operating a swivel to re-orient a print frame from a horizontal printing position to a vertical printing orientation, and orienting a print head to the vertical printing orientation by rotating the print head around a transverse rail mounted between two side rails while translating the print head along the transverse rail and translating the transverse rail along the side rails. A linear actuator is operated on a nozzle of the print head based on signals from a distance sensor, and an initial flight speed of an ink droplet from the nozzle is set using a first electrode. A vertical correction to an ink droplet trajectory is applied using a second electrode subsequent to the first electrode along the ink droplet trajectory. The vertical correction may correspond to a computed in-flight gravitational displacement of the ink droplet, based on a speed of the ink droplet and a distance of the print head from the printing surface. The manner of computing such a gravitational displacement of an in-flight object is known in the art. Setting the vertical correction is selectively activated as a result of orienting the print head in the vertical printing orientation.

The second electrode may be operated to fine-tune the flight speed of the ink droplet received from the first electrode. This may occur only in the vertical printing configuration 200, or in both the horizontal printing configuration 100 and the vertical printing configuration 200. The fine tuning may be based on a distance between the nozzle and a print surface, and provided by the distance sensor.

The controller may be operated to set an initial displacement of the nozzle from the print surface based on the distance, and to dynamically alter a nozzle displacement from the print surface using the linear actuator during printing, based on the distance (e.g., gross contours of the print surface).

Referring now to FIG. 5, in block 502 of FIG. 5, the printing process 500 operates a swivel to re-orient a print frame from a horizontal printing position to a vertical printing position. In block 504, the printing process 500 rotates a print head around a transverse rail mounted between two side rails. In opening loop block 506, while translating the print head along the transverse rail, the printing process 500 translates the transverse rail along the side rails. In block 508, the printing process 500 operates a linear actuator on a nozzle of print head based on signals from a distance sensor. In block 510, the printing process 500 sets an initial flight speed of an ink droplet from the nozzle using a first electrode. In block 512, the printing process 500 sets a vertical correction to an ink droplet trajectory using a second electrode subsequent to the first electrode along the ink droplet trajectory.

Figure 6:
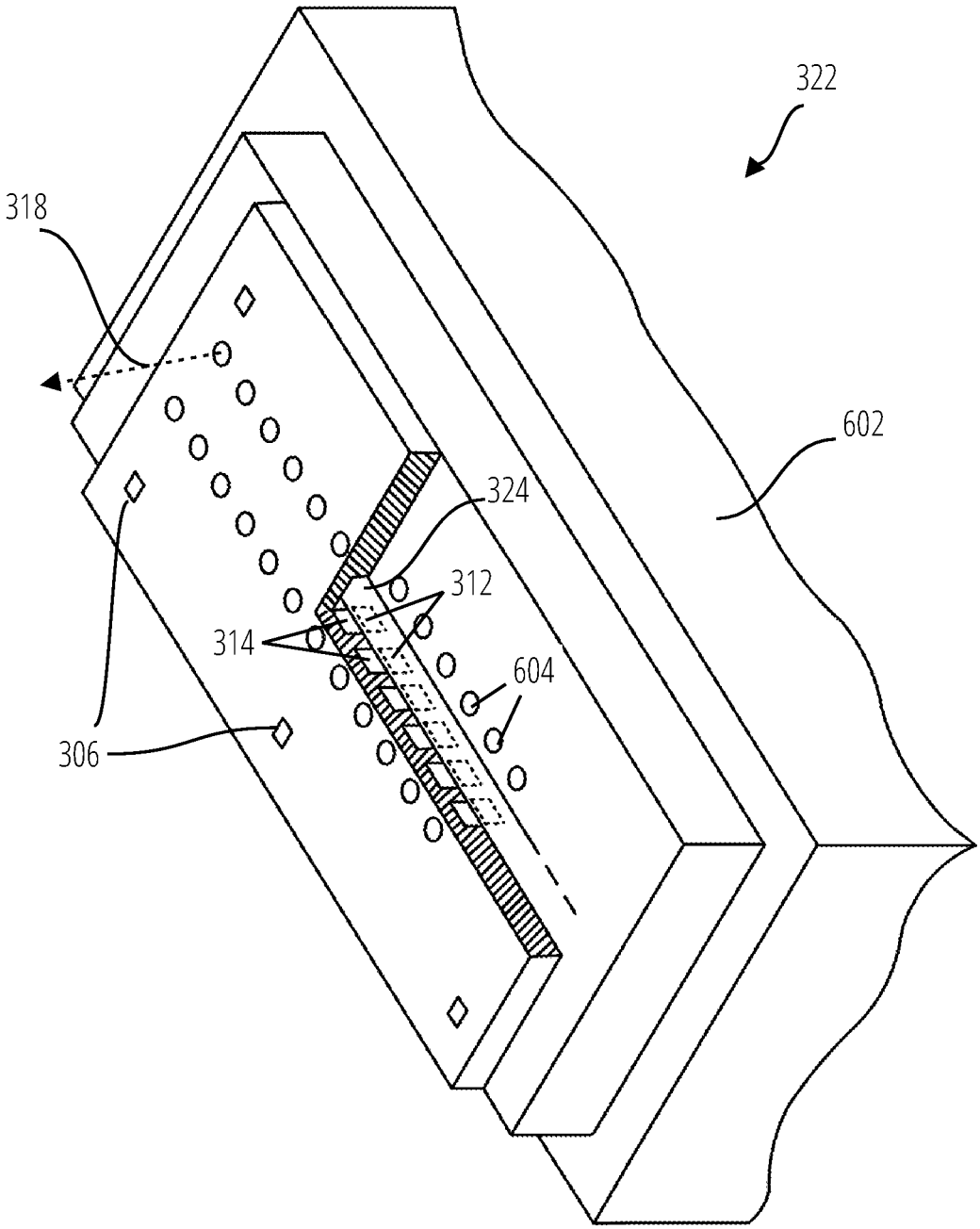
FIG. 6 illustrates a print head face 322 in accordance with one embodiment.

Referring now to FIG. 6, a print head face 322 in one embodiment comprises a substrate 602 formed with a plurality of ink channels 604, each of the ink channels 604 comprising a first electrode 312 and a second electrode 314 controlled via the electrode control paths 324. One or more distance sensor 306 is provided at the surface of the print head face 322. In this embodiment, each ink channels 604 has an associated first electrode 312 and second electrode 314. This provides per-channel control of the ink ejected from each ink channels 604 and very accurate printing on irregular surfaces. The linear actuator 310 positions the print head face 322 at a course level relative to the irregular vertical print surface 316, and the electrodes on each of the ink channels 604 provide fine-grained control of the ink droplet speed based on fine irregularities on the irregular vertical print surface 316. A tradeoff is that the controller 308 in this embodiment is more complicated due to providing fine-grained control of ink drop flight speed for each of the ink channels 604.

The substrate 602 may be formed of, for example, plastic, glass, ceramics, resin, metal, silicon, or the like. The ink channels 604 form paths through the substrate 602 through which ink flows, from the ink tank 304 through ejection ports on the surface of the substrate 602. In this example, the inkjet print head face 322 is provided with a first row of the ejection ports which are arranged such that the longitudinal axes of the respective ejection ports are parallel to each other, and a second ejection-port row of the ejection ports which are arranged such that the longitudinal axes of the respective ejection ports are parallel to each other. The adjacent ejection ports are arranged at intervals corresponding to the highest available resolution of the inkjet printer such as 600-dpi pitches or 1200-dpi pitches. The ejection ports in the second ejection-port row and the corresponding ejection ports in the first ejection-port row are staggered apart by a pitch between adjacent ejection ports as called for in the implementation.

Figure 7:
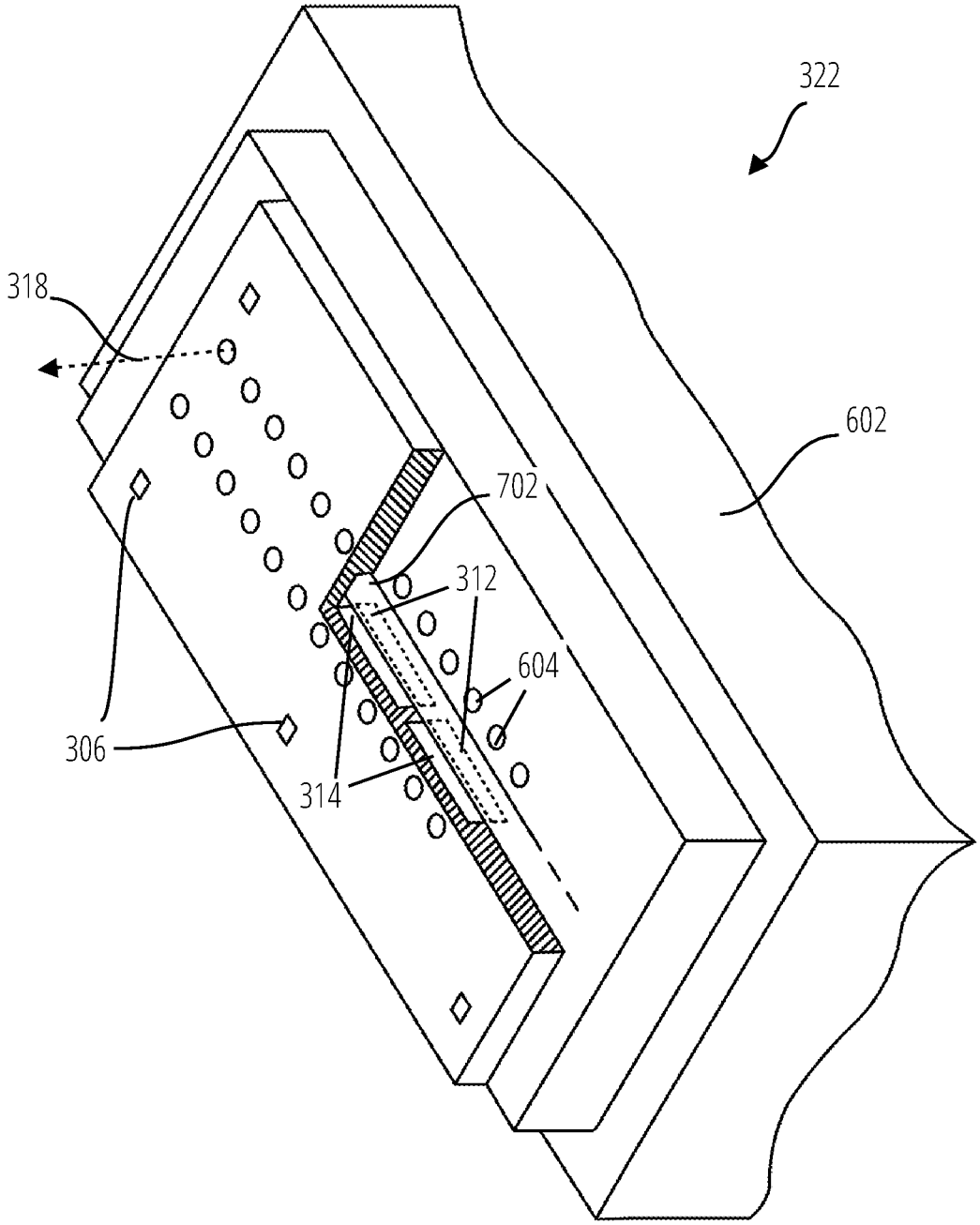
FIG. 7 illustrates a print head face 322 in accordance with another embodiment.

Referring to FIG. 7, a print head face 322 in another embodiment comprises substantially similar features to the print head face 322 embodiment of FIG. 6. However, in this embodiment, groups of the ink channels 604 (in this example, groups of three) share an associated first electrode 312 and second electrode 314. This provides somewhat less than the per-channel ink drop flight control of the embodiment of FIG. 6, but the controller 308 may be simplified while still providing relatively fine-grained control of the ink droplet speed based on fine irregularities on the irregular vertical print surface 316. The number of the ink channels 604 in a group may vary depending on the requirements of the implementation, up to an embodiment in which all of the ink channels 604 share the same first electrode 312 and second electrode 314.

In some embodiments, all of the ink channels 604 in a row or column share a common first electrode 312 and second electrode 314; or, 2x2, 4x4, or any size grids of the ink channels 604 may share a common first electrode 312 and second electrode 314, etc. A distance sensor 306 may be associated proximate to each group of ink channels 604 (or to groups of channel groups), to provide local distance readings for fine-tuning the flight speed of ink droplets from each group of ink channels 604.

Figure 8:
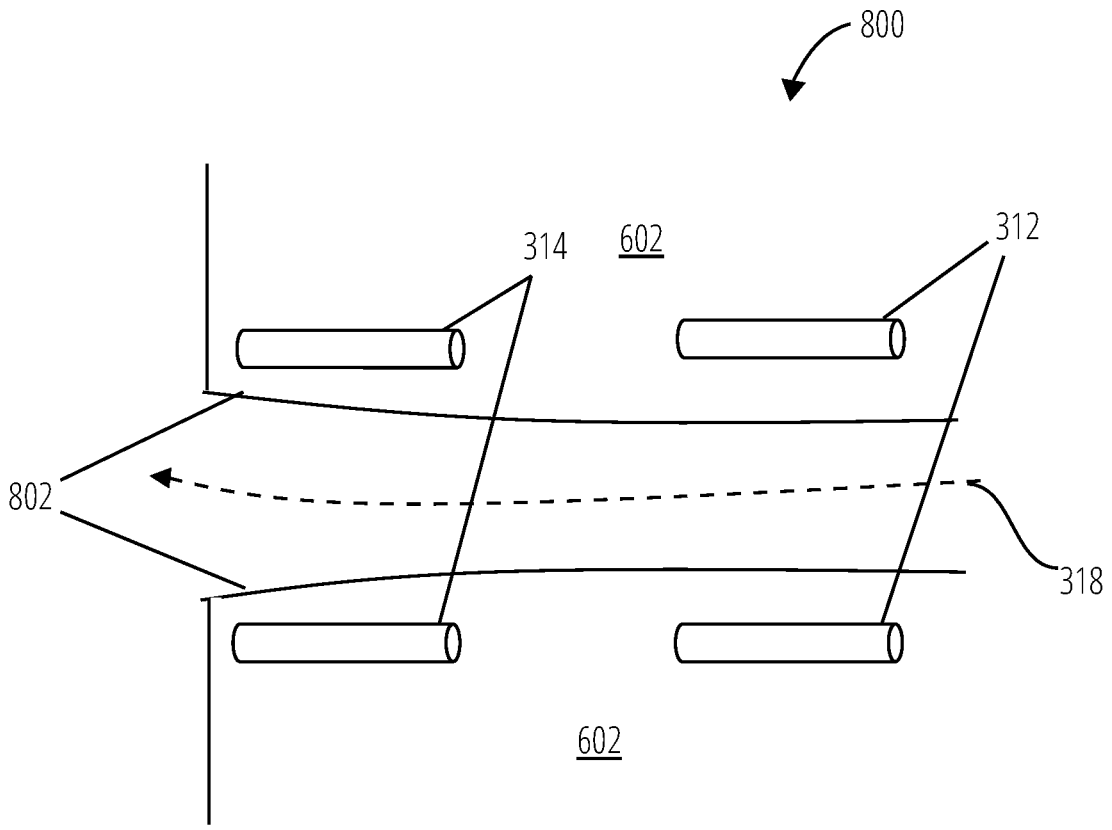
FIG. 8 illustrates an ink channel 800 in accordance with one embodiment.

Referring to FIG. 8, an ink channel 800 in one embodiment is formed with a flare 802 at an end at an exit from the substrate 602 of the print head face 322. In a vertical printing mode, the ink droplet path 318 bends downward slightly as the ink droplet accelerates through the first electrode 312, and the second electrode 314 provides an upward deflection to compensate for the slight drop and for an additional drop to be expected before the ink droplet reaches the irregular vertical print surface 316, based on signals from the distance sensor 306. The flare 802 provides some additional space for the deflection of the ink droplet by the second electrode 314, enabling greater deflection settings and thus greater compensation for distance from the irregular vertical print surface 316.

Figure 9:
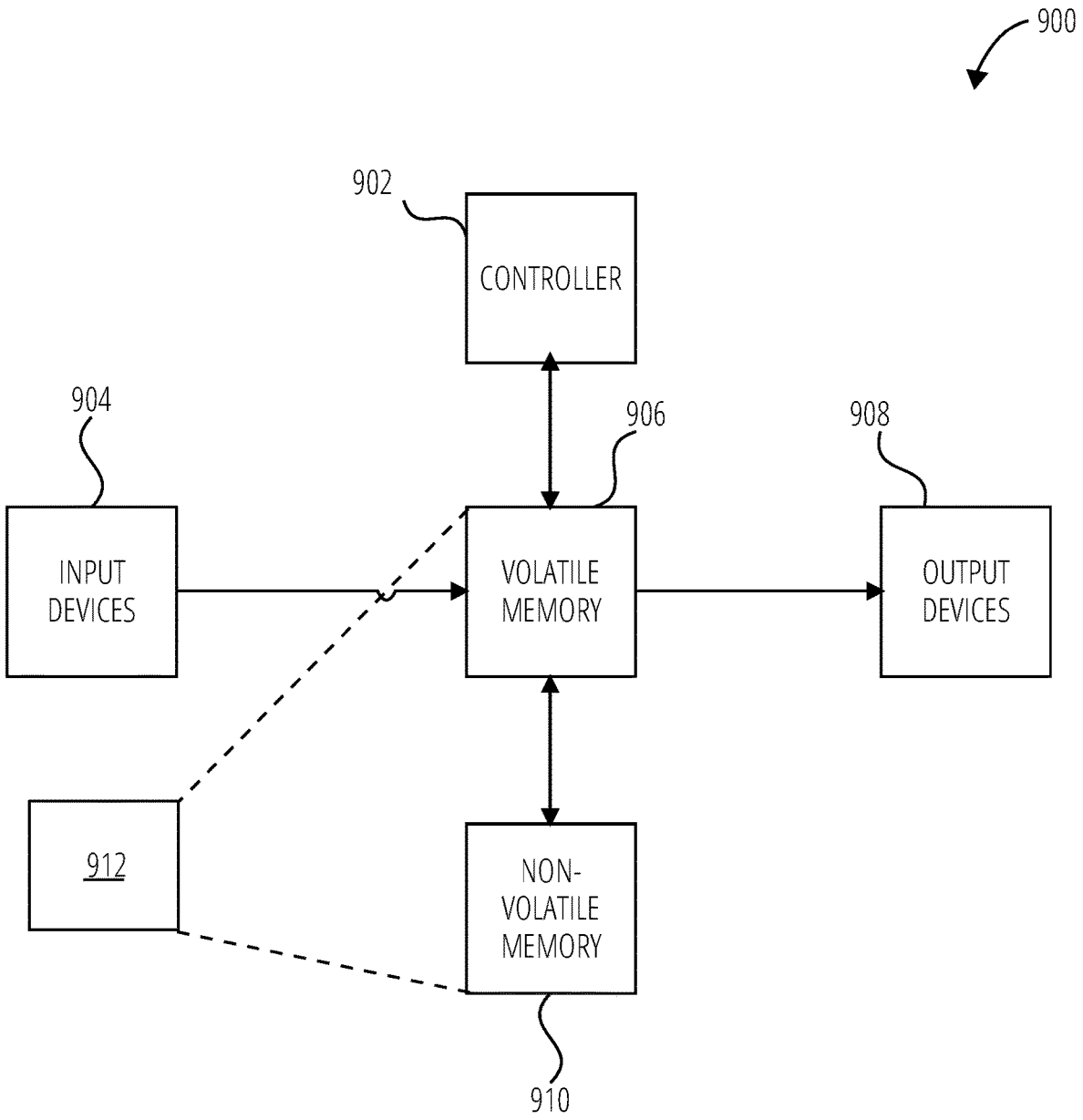
FIG. 9 illustrates an embodiment of a print head control system 900 to implement components and process steps of the system described herein.

FIG. 9 illustrates an embodiment of a print head control system 900 to implement components and process steps of the system described herein.

Input devices 904 comprise transducers that convert physical phenomenon into machine internal signals, typically electrical, optical or magnetic signals. Signals may also be wireless in the form of electromagnetic radiation in the radio frequency (RF) range but also potentially in the infrared or optical range. Examples of input devices 904 are distance sensors that detect proximity to a surface, and level switches or accelerometers that detect orientation relative to a gravitational field. The signals from the input devices 904 are provided via various machine signal conductors (e.g., busses or network interfaces) and circuits to volatile memory 906, or in some cases directly to the controller 902.

The volatile memory 906 is typically what is known as a first or second level memory device, providing for storage (via configuration of matter or states of matter) of signals received from the input devices 904, instructions and information for controlling operation of the controller 902, and signals from non-volatile memory 910.

The volatile memory 906 and/or the non-volatile memory 910 may store computer-executable instructions and thus forming logic 912 that when applied to and executed by the controller 902 implement embodiments of the processes disclosed herein, e.g., printing process 500.

Information stored in the volatile memory 906 is typically directly accessible to the controller 902 of the device. Signals input to the device cause the reconfiguration of the internal material/energy state of the volatile memory 906, creating in essence a new machine configuration, influencing the behavior of the print head control system 900 by affecting the behavior of the controller 902 with control signals (instructions) and data provided in conjunction with the control signals.

Second or third level non-volatile memory 910 may provide a slower but higher capacity machine memory capability. Examples of non-volatile memory 910 are flash memories or other non-volatile memory technologies well known in the art.

The controller 902 may cause the configuration of the volatile memory 906 to be altered by signals in non-volatile memory 910. In other words, the controller 902 may cause data and instructions to be read from non-volatile memory 910 in the volatile memory 906 from which may then influence the operations of controller 902 as instructions and data signals, and from which it may also be provided to the output devices 908. The controller 902 may alter the content of the volatile memory 906 by signaling to a machine interface of volatile memory 906 to alter the internal configuration, and then converted signals to the non-volatile memory 910 to alter its material internal configuration. In other words, data and instructions may be backed up from volatile memory 906, which is often volatile, to non-volatile memory 910, which are often non-volatile.

Output devices 908 are transducers which convert signals received from the volatile memory 906 into physical phenomenon such as electrical fields (e.g., on electrodes) and mechanical actuation.

Terms used herein should be accorded their ordinary meaning in the relevant arts, or the meaning indicated by their use in context, but if an express definition is provided, that meaning controls.

"Circuitry" in this context refers to electrical circuitry having at least one discrete electrical circuit, electrical circuitry having at least one integrated circuit, electrical circuitry having at least one application specific integrated circuit, circuitry forming a general purpose computing device configured by a computer program (e.g., a general purpose computer configured by a computer program which at least partially carries out processes or devices described herein, or a microprocessor configured by a computer program which at least partially carries out processes or devices described herein), circuitry forming a memory device (e.g., forms of random access memory), or circuitry forming a communications device (e.g., a modem, communications switch, or optical-electrical equipment).

"Firmware" in this context refers to software logic embodied as processor-executable instructions stored in read-only memories or media.

"Hardware" in this context refers to logic embodied as analog or digital circuitry.

"Logic" in this context refers to machine memory circuits, non transitory machine readable media, and/or circuitry which by way of its material and/or material-energy configuration comprises control and/or procedural signals, and/or settings and values (such as resistance, impedance, capacitance, inductance, current/voltage ratings, etc.), that may be applied to influence the operation of a device. Magnetic media, electronic circuits, electrical and optical memory (both volatile and nonvolatile), and firmware are examples of logic. Logic specifically excludes pure signals or software per se (however does not exclude machine memories comprising software and thereby forming configurations of matter).

"Programmable device" in this context refers to an integrated circuit designed to be configured and/or reconfigured after manufacturing. The term "programmable processor" is another name for a programmable device herein. Programmable devices may include programmable processors, such as field programmable gate arrays (FPGAs), configurable hardware logic (CHL), and/or any other type programmable devices. Configuration of the programmable device is generally specified using a computer code or data such as a hardware description language (HDL), such as for example Verilog, VHDL, or the like. A programmable device may include an array of programmable logic blocks and a hierarchy of reconfigurable interconnects that allow the programmable logic blocks to be coupled to each other according to the descriptions in the HDL code. Each of the programmable logic blocks may be configured to perform complex combinational functions, or merely simple logic gates, such as AND, and XOR logic blocks. In most FPGAs, logic blocks also include memory elements, which may be simple latches, flip-flops, hereinafter also referred to as "flops," or more complex blocks of memory. Depending on the length of the interconnections between different logic blocks, signals may arrive at input terminals of the logic blocks at different times.

"Software" in this context refers to logic implemented as processor-executable instructions in a machine memory (e.g. read/write volatile or nonvolatile memory or media).

Herein, references to "one embodiment" or "an embodiment" do not necessarily refer to the same embodiment, although they may. Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively, unless expressly limited to a single one or multiple ones. Additionally, the words "herein," "above," "below" and words of similar import, when used in this application, refer to this application as a whole and not to any particular portions of this application. When the claims use the word "or" in reference to a list of two or more items, that word covers all of the following interpretations of the word: any of the items in the list, all of the items in the list and any combination of the items in the list, unless expressly limited to one or the other. Any terms not expressly defined herein have their conventional meaning as commonly understood by those having skill in the relevant art(s).

Various logic functional operations described herein may be implemented in logic that is referred to using a noun or noun phrase reflecting said operation or function. For example, an association operation may be carried out by an "associator" or "correlator". Likewise, switching may be carried out by a "switch", selection by a "selector", and so on.

What is claimed is:

1. A print head for an inkjet printer, the print head comprising:

a nozzle;

a first electrode positioned after the nozzle in an ink droplet path;

a second electrode positioned after the first electrode in the ink droplet path;

a controller configured to operate the first electrode to ionize an ink droplet in the ink droplet path and to set a flight speed of the ink droplet; and the controller configured to selectively activate the second electrode to deflect the ink droplet in response to the print head changing from a horizontal printing orientation to a vertical printing orientation.

2. The print head of claim 1, the controller configured to operate the second electrode to fine-tune the flight speed of the ink droplet received from the first electrode.

3. The print head of claim 1, further comprising:

a distance sensor configured to provide a measure of a distance between the print head and a print surface.

4. The print head of claim 3, the controller coupled to the distance sensor, the controller configured to:

set an initial nozzle displacement from the print surface based on the distance; and dynamically alter the nozzle displacement from the print surface during printing, based on the distance.

5. The print head of claim 4, further comprising: a linear actuator coupled to the nozzle; and wherein the controller is configured to operate the linear actuator to alter the nozzle displacement.

6. The print head of claim 5, wherein the linear actuator is a telescoping push/pull actuator.

7. The print head of claim 5, further comprising:

a coupling configured to provide rotational and translational positioning of the print head on a transverse rail.

8. An inkjet printer, comprising:

a horizontal printing configuration;

a vertical printing configuration; and a print frame, the print frame comprising:

a swivel;

at least one side rail mounted to the swivel;

a transverse rail mounted to slide along a length of the side rails;

a print head mounted to slide along a length of the transverse rail;

the print head further mounted to rotate around the transverse rail;

the print head comprising:

a nozzle mounted to a linear actuator;

a first electrode positioned after the nozzle along an ink droplet path;

a controller configured to set an initial flight speed of an ink droplet in the ink droplet path;

a second electrode positioned after the first electrode along the ink droplet path;

the controller configured to rotate the print frame to change the inkjet printer between the horizontal printing configuration and the vertical printing configuration, wherein the print head is, when the inkjet printer is in the horizontal printing configuration, configured to face a horizontal print surface and to discharge an ink droplet in a vertical direction to a printing medium on the horizontal print surface and the print head is, when the inkjet printer is in the vertical printing configuration, configured to face a vertical print surface and discharge an ink droplet in a horizontal direction to the printing medium;

the controller further configured to operate the second electrode in response to rotation from the horizontal printing configuration to the vertical printing configuration to apply a vertical correction to an ink droplet in the ink droplet path and to change the initial flight speed of the ink droplet based on a distance of the nozzle from a print surface when in the vertical printing configuration.

9. The inkjet printer of claim 8, further comprising a distance sensor configured to provide a measure of the distance of the nozzle from the print surface.

10. The inkjet printer of claim 9, the controller further configured to:

set an initial nozzle displacement from the print surface based on the distance; and dynamically alter the nozzle displacement from the print surface during printing, based on the distance.

11. The inkjet printer of claim 10, the controller further configured to:

operate the linear actuator to alter the nozzle displacement.

12. A method of operating an inkjet printer, the method comprising:

operating a swivel to orient a print frame from a horizontal printing position to a vertical printing orientation;

orienting a print head to the vertical printing orientation by rotating the print head around a transverse rail mounted between two side rails;

while translating the print head along the transverse rail and translating the transverse rail along the side rails:

operating a linear actuator on a nozzle of the print head based on signals from a distance sensor;

setting an initial flight speed of an ink droplet ejected from the nozzle using a first electrode;

setting a vertical correction to a trajectory of the ink droplet using a second electrode positioned after the first electrode along the trajectory of the ink droplet; and wherein setting the vertical correction is selectively activated as a result of orienting the print head in the vertical printing orientation.

13. The method of claim 12, further comprising:

operating the second electrode to fine-tune the flight speed of the ink droplet.

14. The method of claim 13, wherein the fine tuning is performed based on a distance between the nozzle and a print surface.

15. The method of claim 14, wherein the distance is provided by the distance sensor.

16. The method of claim 12, further comprising:

the distance sensor providing a measure of a distance between the nozzle and a print surface.

17. The method of claim 16, further comprising:

operating a controller to set an initial displacement of the nozzle from the print surface based on the distance; and dynamically altering a nozzle displacement from the print surface with the linear actuator during printing, based on the distance.

* * * * *